US005143580A

United States Patent [19]

Basta et al.

[11] Patent Number: 5,143,580

[45] Date of Patent: Sep. 1, 1992

[54] PROCESS FOR REDUCING THE AMOUNT OF HALOGENATED ORGANIC COMPOUNDS IN SPENT LIQUOR FROM A PEROXIDE-HALOGEN BLEACHING SEQUENCE

[75] Inventors: Jiri J. Basta, Partille; Lillemor K. Holtinger, Nödinge; Marie R. Samuelsson, Stenungsund; Per G. Lundgren, Väröbacka, all of Sweden

[73] Assignee: Eka Nobel AB, Bohus, Sweden

[21] Appl. No.: 689,502

[22] Filed: Apr. 23, 1991

[30] Foreign Application Priority Data

Apr. 23, 1990 [SE] Sweden ..... 9001449

[51] Int. Cl.[5] ..... D21C 9/14; D21C 9/16

[52] U.S. Cl. ..... 162/40; 162/76; 162/78; 162/88

[58] Field of Search ..... 162/76, 78, 40, 88, 162/65

[56] References Cited

U.S. PATENT DOCUMENTS

| | | | |
|---|---|---|---|
| 3,251,731 | 5/1966 | Gard | 162/71 |
| 3,865,685 | 2/1975 | Hebbel et al. | 162/78 |
| 4,222,819 | 9/1980 | Fossum et al. | 162/76 |
| 4,459,174 | 7/1984 | Papageorges et al. | 162/78 |
| 4,732,650 | 3/1988 | Michalowski et al. | 162/78 |
| 4,826,568 | 5/1989 | Gratzl | 162/76 |
| 4,946,556 | 8/1990 | Prough | 162/76 |

FOREIGN PATENT DOCUMENTS

| | | |
|---|---|---|
| 57944 | 4/1985 | Australia . |
| 575636 | 5/1959 | Canada . |
| 946107 | 4/1974 | Canada . |
| 1080406 | 7/1980 | Canada . |
| 1206704 | 7/1986 | Canada . |
| 285530 | 5/1988 | European Pat. Off. . |
| 3620980 | 1/1988 | Fed. Rep. of Germany . |
| 903429 | of 1980 | U.S.S.R. . |

OTHER PUBLICATIONS

Anderson et al., "Optimized Hydrogen Peroxide Bleaching in Closed White-water Systems", *Tappi*, Apr. 1980, p. 111.

Gellerstedt et al., Journal of Wood Chemistry and Technology, vol. 2, No. 3, pp. 231-250 (1982).

R. D. Spitz, Tappi Journal, vol. 44, No. 10, pp. 731-734 (1961).

C-J Alfthan et al., Svensk Papperstidning (Swedish Paper Journal) No. 15, pp. 480-482 (1977).

J. Bottger et al., "Das Papier", vol. 40, 1986, No. 10A, pp. V25-33.

Fennell et al., Tappi, "Hydrogen Peroxide for Bleaching Kraft Pulp" vol. 51, No. 1 (1968).

*Primary Examiner*—Steve Alvo

*Attorney, Agent, or Firm*—Burns, Doane, Swecker & Mathis

[57] ABSTRACT

A process for delignification and bleaching of chemically digested lignocellulose-containing pulp for reduced formation and discharge of halogenated organic compounds, while preserving the pulp quality, where the prebleaching with halogen-containing bleaching agent is replaced by a treatment, in a first step, with the addition of a complexing agent at elevated temperature and at a pH from 3.1 to 9.0, and in a second step, by using a peroxide-containing compound under alkaline conditions, whereupon spent liquor from the final bleaching with halogen-containing compounds is recycled to the first or second step of the halogen-free prebleaching.

9 Claims, No Drawings

PROCESS FOR REDUCING THE AMOUNT OF HALOGENATED ORGANIC COMPOUNDS IN SPENT LIQUOR FROM A PEROXIDE-HALOGEN BLEACHING SEQUENCE

The present invention relates to a process for delignification and bleaching of lignocellulose-containing materials for reduced formation and discharge of halogenated organic compounds while preserving the pulp quality, where prebleaching with halogen-containing bleaching agent is replaced by a treatment, in a first step, with added complexing agent at elevated temperature and at a pH from 3.1 to 9.0, and in a second step, by using a peroxide-containing compound under alkaline conditions, whereupon spent liquor from the final bleaching with halogen-containing compounds is recycled to the first or second step of the halogen-free prebleaching. The combination of a substantially reduced use of halogen-containing bleaching agents, especially chlorine, and heat treatment of spent liquor from the stages where AOX is formed, reduces the content of AOX (=adsorbable organic halogens) to a very low level. Subsequently, therefore, waste water from these initial steps can be directly discharged to the recipient.

Lignocellulose-containing materials refer to chemical pulps from softwood and/or hardwood, digested according to the sulphite, sulphate, soda or organosolv process, or modifications and/or combinations thereof. Before the bleaching sequence with a complexing agent and peroxide-containing compound, the pulp may also have been delignified in an oxygen stage.

BACKGROUND

In the production of chemical pulp of high brightness, wood chips are first cooked to separate the cellulose fibers. During the cooking, part of the lignin holding the fibers together is degraded and modified such that it can be removed by subsequent washing. However, in order to achieve sufficient brightness, more lignin must be removed, together with brightness impairing (chromophoric) groups. This is frequently effected by delignification with oxygen, followed by bleaching in several stages.

A conventional bleaching sequence for a digested lignocellulose-containing pulp, e.g. kraft pulp from softwood, is (C+D) $E_1$ D $E_2$ D, where (C+D)=chlorine/chlorine dioxide stage, E =alkaline extraction stage, D=chlorine dioxide stage. The (C+D) and $E_1$ stages are defined as prebleaching stages. The sequence D $E_2$ D is called final bleaching.

If an alkaline oxygen stage is used before the prebleaching sequence of multi-stage bleaching of, for example, kraft pulp, it is possible to reduce the discharge by more than half the original amount, since spent oxygen bleach liquor not containing chlorine is recoverable. However, after an oxygen delignification stage, the lignin remaining in the pulp is about half of the amount remaining after the digestion in the cooking process, which thus at least partly has to be dissolved out of the pulp. This is achieved in the subsequent bleaching.

Bleaching of chemical pulps is mainly carried out with chlorous bleaching agents, such as chlorine, chlorine dioxide and hypochlorite, resulting in spent bleach liquors containing halogenated organic compounds and chlorides. The corrosive tendency of the latter, makes it difficult to close the bleach plant and the halogenated organic compounds mean discharges detrimental to the environment. Therefore, nowadays there is a strive towards the use of, to the greatest possible extent, bleaching agents poor in or free from chlorine, so as to reduce the discharges and make possible the recovery of spent liquors. Examples of such bleaching agents are peroxides, e.g. inorganic peroxides, such as hydrogen peroxide and sodium peroxide, and organic peroxides, such as peracetic acid. The formation of compounds detrimental to the environment is especially pronounced in the prebleaching, where the content of lignin is high. Therefore, the greatest effect of a change to bleaching agents which are less harmful to the environment, such as hydrogen peroxide, is obtained in the prebleaching. In actual practice, however, hydrogen peroxide is not used to any appreciable extent in the first stage of a bleaching sequence to obtain an initial reduction of lignin and/or an increase in brightness, because of the large amounts of added hydrogen peroxide which are necessary.

Thus, large amounts of hydrogen peroxide must be added in alkaline hydrogen peroxide treatment to obtain a satisfactory dissolution of lignin, since such a treatment gives a high degree of decomposition of the hydrogen peroxide, resulting in considerable costs for the chemicals. In acidic hydrogen peroxide treatment, the same dissolution of lignin can be obtained as in alkaline treatment with a much lower consumption of hydrogen peroxide. However, the acidic treatment results in a substantial drop in the viscosity of the pulp, i.e. the decomposition products of the hydrogen peroxide, at low pH values attack not only the lignin, but also the cellulose, so that the length of the carbohydrate chains is reduced, resulting in impaired strength properties of the pulp.

According to SE-A 420,430, this drop in the viscosity in an acidic hydrogen peroxide treatment can be avoided by carrying it out in the presence of a complexing agent, such as DTPA (diethylenetriaminepentaacetic acid), at a pH of 0.5 to 3.0. This treatment step is followed by an alkaline extraction stage for removal of dissolved lignin, without intermediate washing.

TECHNICAL PROBLEM

The purpose of various pretreatment steps is to reduce the lignin content before the first chlorous stage and thus reduce the need for chlorine and thereby reduce the content of AOX, or as it is also stated TOCl (=total organic chlorine), in the spent bleach liquor. Examples of processes where the kappa number (which is a measure of the lignin content) is reduced, is by modifying the cooking process or by using a combination of oxygen and nitrogen compounds according to the so called PRENOX-process. However, these processes require uneconomically large investments. The value of AOX can be lowered also by replacing the (C+D) stage in a conventional bleaching sequence by a D stage. By this change, the amount of detrimental discharge products formed is substantially reduced. This is valid, although it normally requires a higher charge of chlorine dioxide per ton of pulp, to reduce the lignin content to the necessary low level before the subsequent bleaching. The possibility to obtain a bleach plant system that is more closed is rather limited, since previously known (chlorine chemical-free) pretreatment processes either comprise acidic treatment steps or comprise unacceptable additives from a recovery point of view. To overcome these technical problems in the process expensive equipment need to be set up. The present invention, therefore, aims at solving the problem by modifying, in another fashion, an existing bleaching sequence so that the lowest possible AOX values can be obtained and still give a product of the same or even improved quality.

THE INVENTION

The invention relates to a treatment process in which an initial, halogen-free delignification and bleaching is used to alter the trace metal profile of the pulp, render more efficient the peroxide bleaching and reduce the content of AOX (=adsorbable organic halogens). This treatment is realized by altering the trace metal profile of the pulp (the position and content of each metal present) by treatment, in a first step, with a complexing agent at a pH of from 3.1 to 9.0, whereupon, in a second step, a peroxide treatment is realized under alkaline conditions, and in a third step, spent liquor from the final bleaching with halogen-containing chemicals is recycled to one of the two first steps of the treatment, whereby the existing combination of pH, temperature and time in these steps, brings about a considerable degradation of AOX formed in the final bleaching. This process means considerably less discharges from existing bleaching plants, since the amount of halogen-containing chemicals can be reduced while preserving the pulp quality with respect to brightness, viscosity, kappa number and strength properties.

The invention thus concerns a process for treating lignocellulose-containing pulp as disclosed in the claims. According to the invention, this process for bleaching of chemical pulp relates to a method for reduced formation and discharge of halogenated organic compounds while preserving the brightness and strength, by replacing a (C +D) and E stage in a conventional prebleaching sequence by an initial treatment with a complexing agent, thereby altering the trace metal profile of the pulp, at a pH in the range from 3.1 up to 9.0 and at a temperature in the range from 10° C. up to 100° C. In a second step, the treatment with a peroxide-containing compound is carried out at a pH in the range from 7 up to 13, whereupon spent liquors from the final bleaching stages with halogen-containing chemicals are recycled to the first or second treatment step. The recycling is performed directly to the halogen-free treatment with a complexing agent or peroxide-containing compound, which means that the already small amount of AOX is further reduced in a way that is economically favorable. It is advantageous to recycle the spent liquor from the first final bleaching stage with halogen-containing chemicals to the first treatment step, since there is an extensive agreement between the process conditions in these stages. This is especially valid for the pH, but also for e.g. the temperature. Therefore, preferably the spent liquor from the first bleaching stage with halogen-containing chemicals is recycled to the first treatment step according to the invention.

The process according to the invention is preferably used in such pulp treatment, where the delignification comprises an oxygen stage. The position chosen for carrying out the treatment with a complexing agent and peroxide-containing compound according to the invention, may be either immediately after the digestion of the pulp, or after an oxygen stage.

In the process according to the invention, the first step is suitably carried out at a pH of from 4 to 8, preferably from 5 to 7, and the second step preferably at a pH of from 8 to 12.

The complexing agents employed principally comprise nitrogenous polycarboxylic acids, suitably diethylenetriaminepentaacetic acid (DTPA), ethylenediaminetetraacetic acid (EDTA) or nitrilotriacetic acid (NTA), preferably DTPA or EDTA, polycarboxylic acids, preferably citric acid or tartaric acid, phosphonic acids, preferably diethylenetriaminepentaphosphonic acid, or polyphosphates. The peroxide-containing compound used is preferably hydrogen peroxide or a mixture of hydrogen peroxide and oxygen.

The treatment according to the invention preferably comprises a washing step between the two treatment steps, such that the complex bound metals are removed from the pulp suspension before the peroxide step.

Halogen-containing bleaching chemicals comprise chlorous compounds, such as chlorine, chlorine dioxide, chlorites of alkali metals or alkaline-earth metals and hypochlorites of alkali metals or alkaline-earth metals, but also compounds of fluorine, bromine and iodine are suitable. Halogenated organic compounds relate to separated organic molecules from wood, where halogen has been incorporated in the molecule during treatment with halogen-containing bleaching chemicals. Examples of such organic compounds are cellulose, hemicellulose and aromatic and aliphatic residues of lignin. Examples of halogenated organic compounds are chlorinated residues of lignin, where especially the aromatic compounds are difficult to degrade.

Final bleaching can be carried out with chlorine and/or chlorine dioxide in one or more stages, optionally with an intermediate extraction stage. Suitably, only technical chlorine dioxide is used, since in this case the AOX formation per kg of bleaching agent counted as active chlorine is but a fifth of that of molecular chlorine. Technical chlorine dioxide relates to chlorine dioxide produced by conventional techniques, without external addition of chlorine. In other words, the chlorine dioxide may contain chlorine formed during the production and dissolved in the absorption water. One example of industrial processes in which a certain amount of chlorine is formed, is the reduction of chlorate with chloride. Other chlorate reducing agents, such as sulphur dioxide and methanol, give but minor amounts of chlorine. The chlorine dioxide water from such essentially chlorine-free processes, preferably containing less than 0.5 g chlorine/liter, is especially preferred.

Furthermore, the process according to the invention comprises recycling of spent liquor from one or more of these final bleaching stages to the halogen chemical-free prebleaching according to the invention. Also it is suitable to recycle the spent liquor from final bleaching stages that are acid, e.g. stages with chlorous chemicals, to the treatment with complexing agent and spent liquor from alkaline extraction stages in the final bleaching to the treatment with peroxide. The combination of pH, temperature and residence time in the treatment with complexing agent and peroxide-containing compound, has proven especially suitable to reduce the content of existing halogenated organic compounds in spent liquor from the final bleaching. Thus, the process according to the invention means that a number of environmental advantages are achieved, without major investments.

Preferably the waste water flow from step 1 and step 2 are mixed before being discharged to the recipient. Suitably, the flows are mixed and then kept for at least 5 minutes, preferably from 5 to 180 minutes, before being discharged to the recipient. Most preferably, the waste water flows are mixed as early as possible, which makes it possible to benefit from the high temperature existing in the peroxide-containing step of the treatment. This has a favorable effect on the reduction of AOX and reduces the residence time, which can be critical when treating large volumes of waste water.

In the process according to the invention, the first step is carried out at a temperature of from 10° to 100° C., preferably from 40° to 95° C., during from 1 to 360 minutes, preferably from 5 to 60 minutes, and the second step is carried out at a temperature of from 50° to 130° C., preferably from 60° to 100° C., during from 5 to 960 minutes, preferably from 60 to 360 minutes. The pulp concentration may be from 1 to 50% by weight, preferably from 3 to 30% by weight. In preferred embodiments comprising treatment with nitrogenous polycarboxylic acids in the first step and hydrogen peroxide in the second step, the first step is carried out with a charge of (100% product) from 0.1 to 10 kg/ton of pulp, preferably from 0.5 to 2.5 kg/ton, and the second step with a hydrogen peroxide charge of from 1 to 100 kg/ton, preferably from 5 to 40 kg/ton. The process conditions in both treatment steps are adjusted such that the maximum bleaching effect per kilo of charged peroxide-containing compound is obtained.

In the first treatment step, the pH value may be adjusted by means of sulphuric acid or residual acid from the chlorine dioxide reactor, while the pH in the second step is adjusted by adding to the pulp alkali or an alkali-containing liquid, for example sodium carbonate, sodium hydrocarbonate, sodium hydroxide, or oxidized white liquor.

In the embodiment of the invention where the treatment is carried out after an oxygen stage in the bleaching sequence, the treatment gives an excellent lignin-dissolving effect, since an oxygen treated pulp is more sensitive to a lignin-reducing and/or brightness-increasing treatment with hydrogen peroxide. This treatment, used in combination with a complexing agent and carried out after an oxygen stage, thus gives such good results that from an environmental point of view a substantially improved treatment with a more closed system for the bleaching sequence may be obtained. Efforts have also been made to increase the chlorine-free delignification by using two oxygen stages after one another at the beginning of a bleaching sequence. However, it has been found that after an initial oxygen treatment, it is difficult to use a repeated oxygen treatment to remove such amounts of lignin that the high investment costs for such a stage are justified.

As stated above, a purpose with the process according to the invention is to reduce the discharges of AOX (=adsorbable organic halogens) while preserving the pulp quality, by the use of peroxide and optionally oxygen instead of halogen-containing bleaching agents in the prebleaching. To obtain the same effect with peroxide as with chlorous compounds with respect to delignification, according to the invention it has been found that the pulp must be pretreated with a complexing agent at a pH in the range from 3.1 to 9.0. Hereby, the trace metal profile of the pulp (the position and content of each metal present) can be altered in such a way, that the peroxide selectively degrades the lignin while leaving the cellulose chains practically intact.

In the treatment according to previous processes, the aim has been only to reduce the total content of metals as much as possible, whereas it has been found according to the invention that a trace metal profile altered by selectively changing the content and position of the metals, has a more favorable effect on the pulp quality. It is assumed that the treatment according to the invention, with a first step with a complexing agent at a pH of from 3.1 to 9.0, means that primarily the active trace metals in the vicinity of the cellulose chains are complex bound, while the corresponding metals in immediate vicinity of the lignin are left practically intact. In the subsequent bleaching, the peroxide will be decomposed by these metals and react with the substance closest, i.e. the lignin. Thus, the selectivity of the delignification is dramatically improved. Examples of metals especially detrimental to the degradation of cellulose are manganese, while e.g. magnesium may have a favorable effect on, among other things, the viscosity of the pulp. For this reason, among other metals, magnesium is advantageously not eliminated.

Furthermore, use of the process according to the invention, means a better or unchanged quality of the resulting pulp. In a bleaching process, the aim is a low kappa number, which means a low content of undissolved lignin, and a high brightness of the pulp. Furthermore, the aim is a high viscosity, which means that the pulp contains long carbohydrate chains resulting in a stronger product, and a low hydrogen peroxide consumption resulting in lower treatment costs. In the process according to the invention, all four aims are reached, which is evident from Example 1. Thus, a low kappa number and hydrogen peroxide consumption as well as a high brightness and viscosity are obtained in the treatment with a complexing agent in the pH range from 3.1 to 9.0 and a subsequent alkaline peroxide bleaching. Furthermore, the combination of a high pulp quality and strongly reduced effect on the water course surrounding the bleach plants, is obtained by recycling spent liquor from halogen-containing bleaching stages.

The invention and its advantages are illustrated in more detail by the following Examples which, however, are only intended to illustrate the invention and are not intended to limit the same. The percentages and parts stated in the description, claims and examples, refer to percent by weight and parts by weight, respectively, unless anything else is stated.

EXAMPLE 1

An oxygen delignified kraft pulp from softwood, was treated according to the invention, in step 1 with 2 kg of complexing agent (EDTA) per ton of pulp, for 60 minutes at 90° C. The kappa number and viscosity were 16.9 and 1040 $dm^3/kg$, respectively, before the treatment. In the experiments, pH was varied in step 1 between 1.6 and 10.8. In step 2, 15 kg of hydrogen peroxide was charged per ton of pulp. The pH was 11, the temperature 90° C. and the residence time 240 minutes. The pulp consistency was 10% by weight in both step 1 and 2. The kappa number, viscosity and brightness of the pulp were determined according to SCAN Standard Methods, and the consumption of hydrogen peroxide was measured by iodometric titration. The results obtained are shown in the Table below.

TABLE I

| pH step 1 | Kappa number step 2 | Viscosity step 2 ($dm^3/kg$) | Brightness step 2 (% ISO) | $H_2O_2$ consumption step 2 (kg/ton) |
|---|---|---|---|---|
| 10.8 | 11.3 | 922 | 45.1 | 15.0 |
| 9.1 | 9.8 | 929 | 56.4 | 15.0 |
| 7.7 | 9.0 | 944 | 61.9 | 13.0 |
| 6.7 | 8.8 | 948 | 63.3 | 11.3 |
| 6.5 | 8.6 | 950 | 63.6 | 11.1 |
| 6.1 | 8.3 | 944 | 66.1 | 8.8 |
| 5.8 | 8.5 | 942 | 64.0 | 11.0 |
| 4.9 | 8.5 | 954 | 64.0 | 10.4 |
| 3.8 | 9.0 | 959 | 61.7 | 12.2 |
| 2.3 | 10.8 | 947 | 46.2 | 15.0 |
| 1.8 | 10.6 | 939 | 47.0 | 15.0 |
| 1.6 | 10.4 | 919 | 48.2 | 15.0 |

As is apparent from the Table it is crucial that the treatment in step 1 is carried out in the presence of a complexing agent and within the pH range according to the present invention, to reach the maximum reduction in kappa number and hydrogen peroxide consumption as well as maximum increase in brightness. The selectivity expressed as viscosity at a specific kappa number is higher with a complexing agent present. This is valid within the entire pH range investigated.

EXAMPLE 2

An oxygen delignified kraft pulp from pine, with a kappa number of 16.9 before treatment according to the invention, was treated in the following bleaching sequence: Step 1 step2 $D_0$ EP $D_1$. Here, step 1 represents treatment with a complexing agent, step2 alkaline peroxide bleaching, D0 and $D_1$ a first and second treatment with technical chlorine dioxide, respectively, and finally EP an extraction stage reinforced with peroxide. The total charge of chlorine dioxide and hydrogen peroxide was 35 kg/ton of pulp and 4 kg/ton of pulp, respectively. The final brightness and final viscosity was 89% ISO and 978 $dm^3/kg$, respectively. Spent liquor from this experiment, containing 0.35 kg AOX/ton of pulp, has been recycled from the washing filter after D0 to the inflow to step 1. The temperature in step 1 has been varied between 50° and 90° C. Furthermore, the purifying effect of mixing spent liquor from step 1 and step 2 has been examined. Throughout, the residence time in step 1 was 30 minutes. In the experiment where spent liquor from step 1 and 2 was mixed, the residence time after mixing was increased by approximately 15 minutes, which is a conventional time in a neutralization tower. The content of halogenated organic compounds specified as AOX (=adsorbable organic halogens), was determined according to SCAN-W 9:89. The specimen is acidified with nitric acid and the organic constituents adsorbed batchwise on active carbon. Inorganic chlorous ions are suppressed with nitrate ions. The carbon is burned with oxygen in a quartz tube at approximately 1000° C. Hydrochloric acid thus formed, is absorbed in an electrolytic suspension and determined by microcoulometric titration.

Since the legislations implemented by the authorities specify the content of AOX as kg AOX/ton of pulp, the experimental values have been recalculated by multiplying mg AOX/liter of waste water with liter of waste water/ton of pulp.

The results ar shown in the Table below.

TABLE II

| | Temperature in step 1, °C. | Content of AOX kg/ton | Content of AOX % reduction | pH in white water |
|---|---|---|---|---|
| After $D_0$ | — | 0.35 | — | about 3 |
| After step 1 | 50 | 0.24 | 31.4 | about 5-6 |
| After step 1 | 70 | 0.09 | 74.3 | about 5-6 |
| After step 1 | 90 | 0.05 | 85.7 | about 5-6 |
| After step 1 + step 2 (90°C.) | 90 | 0.03 | 91.4 | about 10 |

In mill trials with the same pulp and bleaching sequence, the following results were obtained:

TABLE III

| | Temperature in step 1, °C. | Content of AOX kg/ton of pulp | Content of AOX % reduction |
|---|---|---|---|
| After $D_0$ | — | 0.383 | — |
| After step 1 | 55 | 0.183 | 47.9 |

As is apparent from Table II, the content of AOX in the waste water is reduced by more than 50% at temperatures above 60° C. in step 1. Since this level is very low to start with —0.35 kg/ton of pulp after $D_0$ —the result is a plant that is almost completely closed with respect to the discharge of AOX. This is especially true if the waste water from step 1 and step 2 are mixed, which gives a further reduction of 40% compared to the result at 90° C. in step 1. Furthermore, the possibility to use existing equipment in the bleach plant to carry out the treatment, makes it very economical. Also, the adjustment of pH before discharge to the recipient can be wholly or partly excluded, since the pH in the waste water from step 1 and/or 2 is higher than in the spent liquor from $D_0$.

Furthermore, a higher temperature in step 1 has a favorable effect on the content of lignin in the pulp after step 2. With a kraft pulp with a kappa number of 21.0 before bleaching, a kappa number of 12.3 is reached after step 2 at 50° C. in step 1. At 90° C. in the first step the result is 12.0, i.e. a not negligible increase in the efficiency of delignification from about 41 to about 43%.

EXAMPLE 3

For comparative purposes, the pulp used in Example 2 was bleached also according to prior art technique. The bleaching sequence according to prior art technique and the invention was 0 (C +D) EP D EP D and 0 Step1 Step2 D EP D, respectively. The content of chlorine dioxide in the (C +D) stage was 50 and 100%, respectively, counted as active chlorine. The results obtained are shown in Table IV.

TABLE IV

| Pretreatment with step 1 | No | No | Yes |
|---|---|---|---|
| % D in (C + D) | 50 | 100 | 100 |
| Chlorine (kg/ton): | 14 | 0 | 0 |
| $ClO_2$ * (kg/ton): | 33 | 78 | 35 |
| Final viscosity ($dm^3/kg$): | 882 | 891 | 948 |
| Final brightness (% ISO) | 90.1 | 90.1 | 90.3 |
| Total AOX (kg/ton): | 2.3 | 0.95 | 0.03 |

* Total $ClO_2$ in the bleaching sequence (as active chlorine)

As is apparent from the Table, the process according to the invention makes it possible to obtain a pulp with equal final brightness as when using conventional bleaching. In this case, however, the AOX content in the waste water is only 3% of the AOX content obtained with a conventional environmental friendly bleaching technique with technical chlorine dioxide only. A total AOX content of 0.03 kg/ton of pulp, was obtained when spent liquor from step 1 and step 2 were mixed at 90° C. (see Table III in Example 2).

We claim:

1. A process for reducing the amount of halogenated organic compounds in the spent liquor from delignification and bleaching of chemically digested lignocellulose-containing pulp, comprising the steps of (a) treating the pulp with a complexing agent, thereby altering the trace metal profile of the pulp, said treating step being carried out at a pH in the range of from about 3.1 to about 9.0 and at a temperature of from about 10° C. to about 100° C., (b) washing the pulp from step (a) to remove the metals complex bound to the complexing agent);

(c) delignifying the pulp from step (b) with a peroxide-containing compound at a pH in the range of from about 7 to about 13;

(d) bleaching the pulp from step (c) with a halogen-containing compound, and (e) recycling the spent bleach liquor from step (d) to one of the preceding steps (a) or (c), wherein the combination of pH, temperature and reaction time in step (a) or (c) brings about a considerable degradation of adsorbable organic halogens formed in step (d).

2. A process according to claim 1 wherein the spent bleach liquor from the halogen-containing bleaching step (d) recycled to the complexing agent treatment step (a).

3. A process according to claim 1, wherein bleaching chemicals containing halogen comprise technical grade chlorine dioxide.

4. A process according to claim 1, wherein the process is carried out after an oxygen stage.

5. A process according to claim 1, wherein the complexing agent treatment step (a) is carried out at a pH of from about 4 to about 8.

6. A process according to claim 1, wherein the complexing agent is diethylenetriaminepentaacetic acid (DTPA) or ethylenediaminetetraacetic acid (EDTA).

7. A process according to claim 1, wherein the peroxide-containing compound is hydrogen peroxide or a mixture of hydrogen peroxide and oxygen.

8. A process according to claim 1, wherein spent liquors from step (a) and step (c) are mixed and kept for from about 5 to about 180 minutes, before being discharged.

9. A process according to claim 1, wherein the complexing agent treatment step (a) is carried out at a temperature of from about 40° to about 95° C. and for a period of from about 1 to about 360 minutes, and wherein step (c) is carried out at a temperature of from about 50° to about 130° C. and for a period of from about 5 to about 960 minutes, the treated pulp having a concentration of from about 1 to about 50% by weight.

* * * * *